US009004338B2

(12) United States Patent
Hamilton

(10) Patent No.: US 9,004,338 B2
(45) Date of Patent: Apr. 14, 2015

(54) ADJUSTABLE DOSE CHAMBER

(75) Inventor: Hamish William Hamilton, Oxford (NZ)

(73) Assignee: GlobalForce IP Limited, Auckland (NZ)

( * ) Notice: Subject to any disclaimer, the term of this patent is extended or adjusted under 35 U.S.C. 154(b) by 842 days.

(21) Appl. No.: 13/130,317

(22) PCT Filed: Dec. 24, 2009

(86) PCT No.: PCT/NZ2009/000306

§ 371 (c)(1), (2), (4) Date: May 20, 2011

(87) PCT Pub. No.: WO2010/082850

PCT Pub. Date: Jul. 23, 2010

(65) Prior Publication Data

US 2011/0226836 A1 Sep. 22, 2011

(30) Foreign Application Priority Data

Dec. 24, 2008 (NZ) ..... 573990
Dec. 24, 2008 (NZ) ..... 573991
Dec. 24, 2008 (NZ) ..... 573992

(51) Int. Cl.
*B25C 1/04* (2006.01)
*B25F 5/00* (2006.01)
*B25D 9/20* (2006.01)

(52) U.S. Cl.
CPC ..... *B25F 5/008* (2013.01); *B25C 1/042* (2013.01); *B25D 9/20* (2013.01)

(58) Field of Classification Search
CPC ..... B25C 1/04; B25C 3/004
USPC ..... 227/8, 10, 130; 91/224, 416; 92/181 P
See application file for complete search history.

(56) References Cited

U.S. PATENT DOCUMENTS 3,229,589 A * 1/1966 Langas ..... 91/416
3,390,606 A * 7/1968 Podgorski ..... 356/459
5,368,007 A 11/1994 Carroll (Continued)

FOREIGN PATENT DOCUMENTS

EP 0 747 175 B1 12/1996

OTHER PUBLICATIONS

WO 2010/082850 A1 (instant PCT application) with International Search Report, dated Apr. 23, 2010.

(Continued)

*Primary Examiner* — Michelle Lopez
(74) *Attorney, Agent, or Firm* — Frederick H. Gribbell

(57) ABSTRACT

A compressible fluid powered device includes a dose chamber. An inlet supplies pressurized fluid to the dose chamber. An outlet for releases pressurized fluid from the dose chamber. A moveable divider divides the dose chamber into a primary space and a secondary space, movement of the divider expanding one space at the expense of the other. At least one flow pathway from one space to the other, which collectively allow gas to flow in both directions past the divider and pressure to equalize across the divider, the flow pathway being much more limited than the outlet.

22 Claims, 3 Drawing Sheets

(56) References Cited

U.S. PATENT DOCUMENTS

| | | | |
|---|---|---|---|
| 6,647,969 | B1 | 11/2003 | Adams |
| 6,786,379 | B2 | 9/2004 | Largo |
| 7,293,684 | B1 | 11/2007 | Wen |
| 2005/0056680 | A1 | 3/2005 | Webb |
| 2008/0185416 | A1 | 8/2008 | Deng |

OTHER PUBLICATIONS

Written Opinion of the International Searching Authority, dated Apr. 23, 2010.

* cited by examiner

ADJUSTABLE DOSE CHAMBER

CROSS-REFERENCE TO RELATED APPLICATIONS

The present application is a National Stage filing of PCT/NZ2009/000306, under the title "ADJUSTABLE DOSE CHAMBER", filed International Stage on Dec. 24, 2009; and claims priority to patent applications: NZ573990, filed Dec. 24, 2008; NZ573991, filed Dec. 24, 2008; and NZ573992, filed Dec. 24, 2008.

BACKGROUND OF THE INVENTION

1. Field of the Invention

The present invention relates to an adjustable dose chamber. The invention has particular application to pneumatically powered tools.

2. Description of the Prior Art

Pneumatic drive systems are used in a variety of applications, particularly with regard to tools. Traditionally, pneumatic tools have been designed to be connected to a source of compressed air, such as a stationary air compressor.

While air compressors do provide an effectively unlimited supply of compressed air, they have several disadvantages. In particular, the need to connect a tool to the air compressor via a hose limits the portability of the tool and also the positions into which it can be manoeuvred. Additionally, air compressors are typically expensive and outside the financial means of some users. Further, safety issues arise from having the hoses lying around the work place which may become caught on various objects or trip up persons within the space.

In an attempt to address these problems, several different systems have been developed.

One such system utilises a combustible gas, such as butane, to provide an explosion that drives the tool's operation. Such combustion systems have safety issues of their own given that the tool usually includes a storage device for combustible gas and a combustion source close to each other. The gas and gas cartridges tend to be expensive and only available from select suppliers. Further, the heat and impact of the combustion tends to be hard wearing on the tool causing them to require frequent maintenance. The electrical components are very susceptible to failure if the tool is exposed to moisture such as rain. All of these factors add additional costs and an element of inconvenience to the user.

More recently, portable pressure sources have been developed by which a vessel containing a pressurised fluid such as carbon dioxide may be connected via a regulator to a tool traditionally powered by an air compressor. These systems allow the tools to be used in a more portable fashion without being restricted by the long hosing requirements of conventional set ups. However because the tools have been designed for a pneumatic set up where the supply of compressed air or gas is effectively unlimited, the energy transfer is relatively inefficient, particularly in the drive mechanism. Therefore, using these portable pressurised fluid systems generally results in the tool only being capable of achieving an impractically low number of repetitions before replacement or replenishment of the fluid vessel is required.

It would therefore be an advantage for the energy transfer mechanism of a pneumatic tool to be more efficient in terms of the consumption of gas per repetition.

Further, it would be advantageous to have the ability to easily adjust the quantity of gas consumed per repetition.

US Patent Application No. 2006/0107939 discloses an adjustable volume chamber for a compressed gas apparatus in the form of a paintball gun. The volume is adjusted by the translation of a sealed piston within the chamber. However if it was desired to adjust the volume of the chamber while pressurised, this adjustment would be against a significant amount of pressure. In a power tool application, the pressure of the system may be in the order of hundreds of psi, and very difficult to work against manually.

It would therefore be advantageous to have the ability to adjust the power of the tool while the system is pressurised.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

DISCLOSURE OF INVENTION

Accordingly, in a first aspect the invention consists in a compressible fluid powered device including

- a dose chamber,
- an inlet for supplying pressurised fluid to the dose chamber,
- an outlet for releasing pressurised fluid from the dose chamber,
- a moveable divider dividing the dose chamber into a primary space and a secondary space, movement of the divider expanding one space at the expense of the other, characterised by

- at least one flow pathway from one space to the other, which collectively allow gas to flow in both directions past the divider and pressure to equalise across the divider, the flow pathway being much more limited than the outlet.

According to another aspect the invention consists in a compressible fluid powered device comprising: a dose chamber, a moveable divider dividing the dose chamber into a primary space and a secondary space, movement of the divider expanding one space at the expense of the other, an inlet for supplying pressurised fluid to the primary space of the dose chamber, an outlet for releasing pressurised fluid from the primary space of the dose chamber, at least one flow pathway from one space to the other, which collectively allow gas to flow in both directions past the divider and pressure to equalise across the divider, the flow pathway being much more limited than the outlet.

According to a further aspect, the outlet includes a valve mechanism in order to control the flow of fluid from the chamber.

According to a further aspect, in the region of the divider, the dose chamber has a circular cross-section.

According to a further aspect, the divider has substantially the same shape and dimensions as a portion of the interior cross-section of the chamber.

According to a further aspect, the divider is moved axially within the chamber.

According to a further aspect, the divider is connected to an adjustment mechanism.

According to a further aspect, the adjustment mechanism includes a rotating member, the end of which is rotatable from outside the chamber.

According to a further aspect, the divider is externally threaded at its connection to the chamber and configured to engage a corresponding threaded portion of the chamber; such that translation of the divider through the chamber is effected by rotating the divider via the rotation member.

According to a further aspect, the flow pathways are formed by the selection of thread pitch between the divider and the chamber such that fluid may flow between the two spaces.

According to a further aspect, the rotation member is threaded and engages a corresponding threaded portion of the chamber; such that as the rotation member is rotated, the rotation member and the attached divider are translated.

According to a further aspect, a portion of the rotation member is threaded and the divider is internally threaded at its connection to the rotation member, the rotation member being configured to be capable of rotation about its axis, but in a fixed axial position within the chamber, such that rotating the rotation member translates the divider within the chamber along the length of the rotation member.

According to a further aspect, the flow pathways are formed by the selection of thread pitch between the divider and the rotation member such that fluid may flow between the two spaces.

According to a further aspect, flow pathways are formed between the edge of the divider and the wall of the chamber.

According to a further aspect, flow pathways comprise ports within the body of the divider.

According to a further aspect, flow pathways comprise separate flow pathways formed in the body of the chamber.

According to a further aspect, the device includes:

a connection for a source of high pressure gas, a conduit leading from the connection to the inlet of the dose chamber, a working chamber where pressurised gas expands to power the device and a valve between the outlet and the working chamber.

According to a further aspect, the device includes:

a piston chamber divided from the outlet of the dose chamber by a valve, a piston slidable in the piston chamber, and an implement drivable by movement of the piston.

According to a further aspect, the implement is a driver blade of a nail gun.

According to a further aspect, the outlet includes a valve, opening in use for an opening time to release fluid from the primary space of the dose chamber reducing the pressure in the primary space of the dose chamber from a high pressure to a low pressure and equalisation of pressure across the divider from a starting point of high pressure in the primary chamber and the low pressure in the secondary dose chamber takes at least four times the opening time.

According to a further aspect, the flow pathway past the divider offers at least four times the resistance as the outlet in use.

In a further aspect the invention consists in a compressible fluid powered device comprising: a dose chamber, a moveable divider dividing the dose chamber into a primary space and a secondary space, movement of the divider expanding one space at the expense of the other, an inlet for supplying pressurised fluid to the primary space of the dose chamber, an outlet for releasing pressurised fluid from the primary space of the dose chamber, at least one flow pathway from one space to the other, which collectively allow gas to flow in both directions past the divider and pressure to equalise across the divider.

In a further aspect the invention consists in a compressible fluid powered device comprising: a dose chamber, a moveable divider dividing the dose chamber into a primary space and a secondary space, movement of the divider expanding one space at the expense of the other, an inlet for supplying pressurised fluid to the primary space of the dose chamber, an outlet for releasing pressurised fluid from the primary space of the dose chamber, at least one flow pathway from one space to the other, the flow pathway being much more limited than the outlet.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The term "comprising" is used in the specification and claims, means "consisting at least in part of". When interpreting a statement in this specification and claims that includes "comprising", features other than that or those prefaced by the term may also be present. Related terms such as "comprise" and "comprises" are to be interpreted in the same manner.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
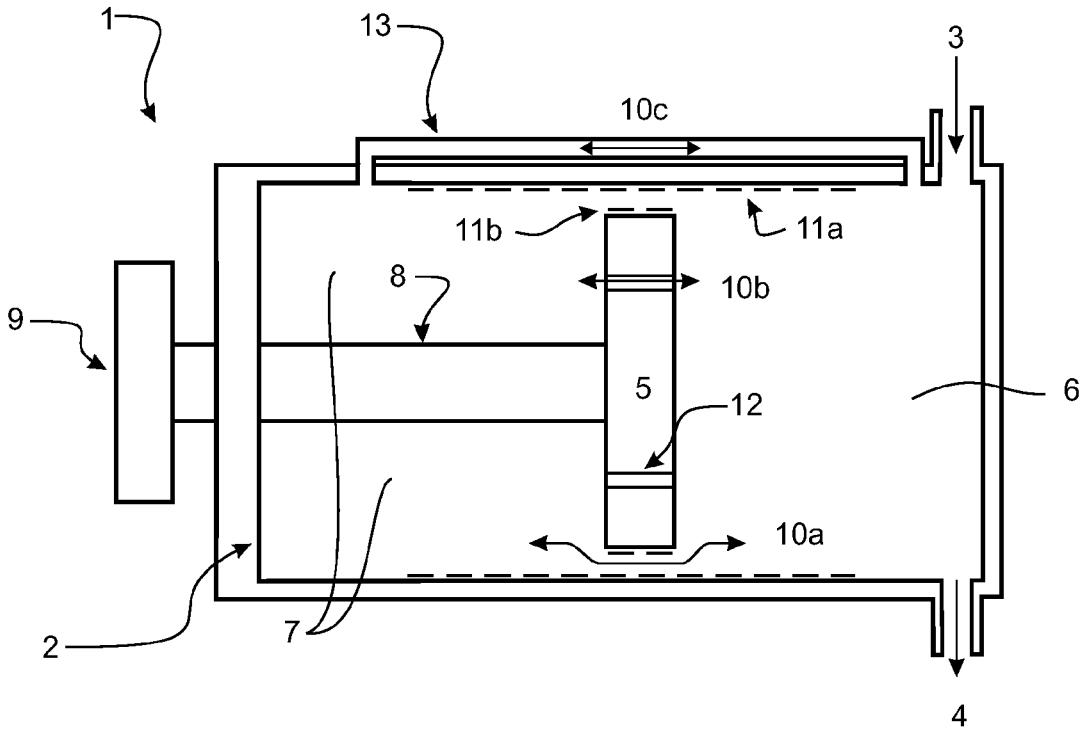
FIG. 1 illustrates the pressurised chamber of the present invention in a preferred embodiment.

FIG. 1 illustrates a pressurised dose chamber of adjustable volume (generally indicated by arrow 1) in a preferred embodiment.

The pressurised chamber (1) includes a dose chamber (2).

The dose chamber (2) includes an inlet (3) and an outlet (4).

The dose chamber (2) is configured to receive a divider (5).

The divider (5) is configured to separate the chamber (2) into a primary space (6) and a secondary space (7).

The divider (5) is connected to an adjustment rod (8).

The adjustment rod (8) is in turn connected to an adjustment knob (9) external to the chamber (2).

The adjustment rod (8) and associated knob (9) are configured to facilitate the axial translation of the divider (5) within the chamber (2). Further detail of this will be described later with reference to FIG. 2.

One or more restricted flow pathways are provided between the primary space (6) and the secondary space (7). The total flow pathway between the two spaces is much more restricted than the outlet (4).

The operation of the pressurised chamber (1) works as follows.

To pressurise the primary space (6), the outlet (4) is sealed by a valve mechanism (not shown) in order to prevent the flow of fluid from the chamber (2).

Fluid flows into the primary space (6) from an external source (not shown) through inlet (3).

Pressure builds in the space (6) until it equalises with the pressure of the source.

While the primary space (6) is pressurised, it may be desirable to adjust the volume of the primary space (6). Flow pathways (10*a*, 10*b*, 10*c*) equalise the pressure between the primary chamber (6) and secondary chamber (7) such that axial translation of the divider (5) along the chamber (2) is easy.

Although the dividing flow pathways (10*a*, 10*b*, 10*c*) allow the pressure in the primary space (6) and secondary space (7) to equalise, the flow rate is significantly lower than that which may be achieved through the outlet (4). Accordingly, when a rapid cycle of releasing the fluid through outlet (4) and then closing outlet (4) is repeated, the flow of gas across the divider is restricted and there is insufficient time for the pressure across the divider to equalise. Accordingly, adjusting the location of the divider (5) adjusts the volume of the high pressure charge for the tool as only a small amount of the high pressure fluid in the secondary chamber is able to escape while the outlet (4) is open.

In the embodiment of FIG. 1, the chamber (2) is provided with helical threads around its perimeter as indicated by the dashed line (11*a*). The divider (5) has corresponding threads, indicated by the dashed lines (11*b*). The helical threads (11*a*, 11*b*) may be slightly offset (for example of slightly different diameter providing a loose engagement) in order to provide the equalising flow pathway (10*a*). The helical threads (11*a*, 11*b*) facilitate the translation of the divider (5) within the chamber (2) by the rotation of the adjustment rod (8) via associated adjustment knob (9).

Equalising flow pathways (10*b*) may additionally or alternatively be provided by the incorporation of ports (12) into the divider (5). The ports (12) may be positioned at any point and angle on the divider (5).

Equalising flow pathway (10*c*) may additionally or alternatively be provided by a channel (13) separate to the divider (5). The channel 13 may be formed through the wall of the pressure chamber.

It should be appreciated that any combination of the flow pathways (10*a*, 10*b*, 10*c*) may be utilised with the present invention, and indeed embodiments of the invention may only utilise one of the equalising flow pathways (10*a*, 10*b*, 10*c*).

Figure 2A:
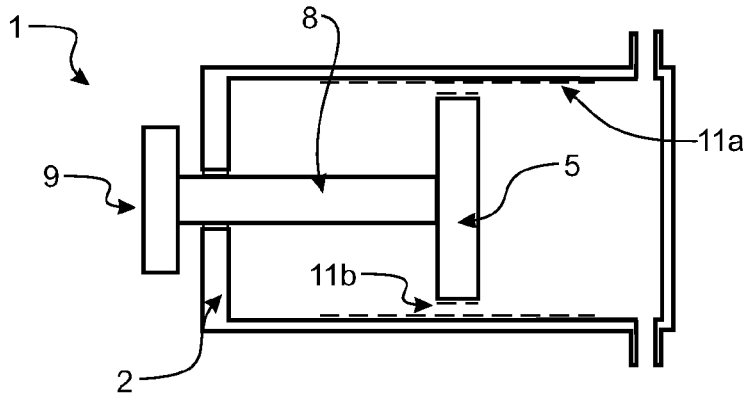
FIGS. 2*a,b,c* illustrate variations in an adjustment mechanism to be used with the present invention.

FIG. 2 illustrates the various ways in which the divider (5) may be translated within chamber (2). In FIG. 2*a*, the chamber (2) includes helical threads (11*a*), and the divider (5) includes corresponding helical threads (11*b*).

By the rotation of adjustment rod (8) via adjustment knob (9) the divider (5) may be translated within the chamber (2).

Figure 2B:
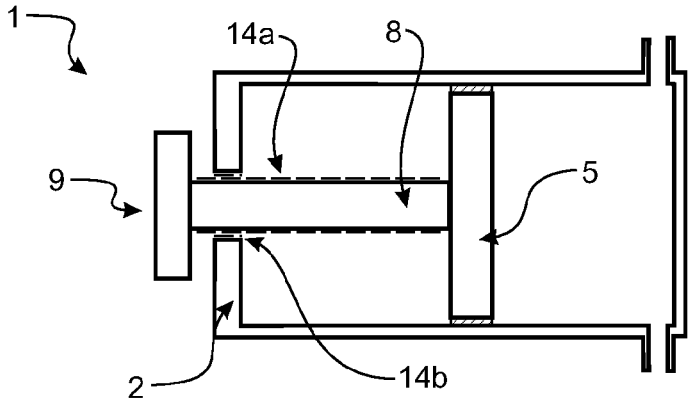

FIG. 2*b* provides an alternate configuration for the translation of the divider (5) within the chamber (2). The adjustment rod (8) is provided with helical threads (14*a*) which engage with helical threads (14*b*) at the point where the chamber meets the adjustment rod (8).

The translation of divider (5) within the chamber (2) is therefore achieved by the rotation of adjustment rod (8) via adjustment knob (9).

Figure 2C:
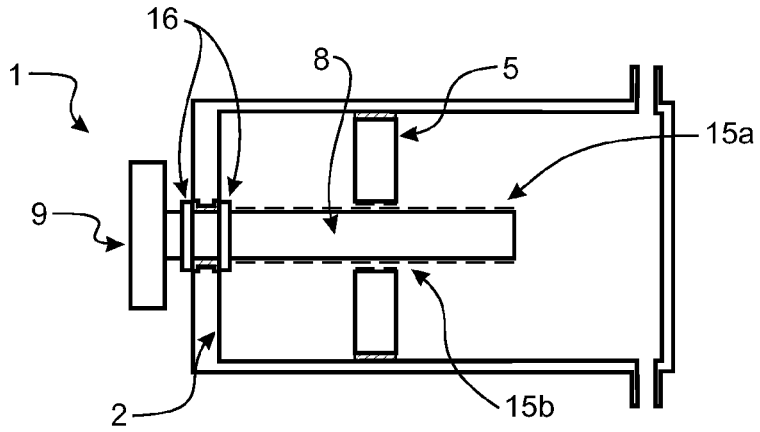

FIG. 2*c* illustrates an alternative configuration to facilitate the translation of the divider (5) within the chamber.

In this configuration, adjustment rod (8) passes through the centre of the divider (5). At the point of connection between the adjustment rod (8) and the divider (5) are provided corresponding helical threads (15*a*, 15*b*) respectively.

In this embodiment, the adjustment-rod (8) does not move axially within the chamber (2). The rod (8) may include a collar or lugs (16) engaging with the end wall of the pressure chamber (2) in order to maintain the axial position of the rod within the chamber (2).

The divider (5) is translated within the chamber (2) by the rotation of adjustment rod (8) via adjustment knob (9).

Figure 3:
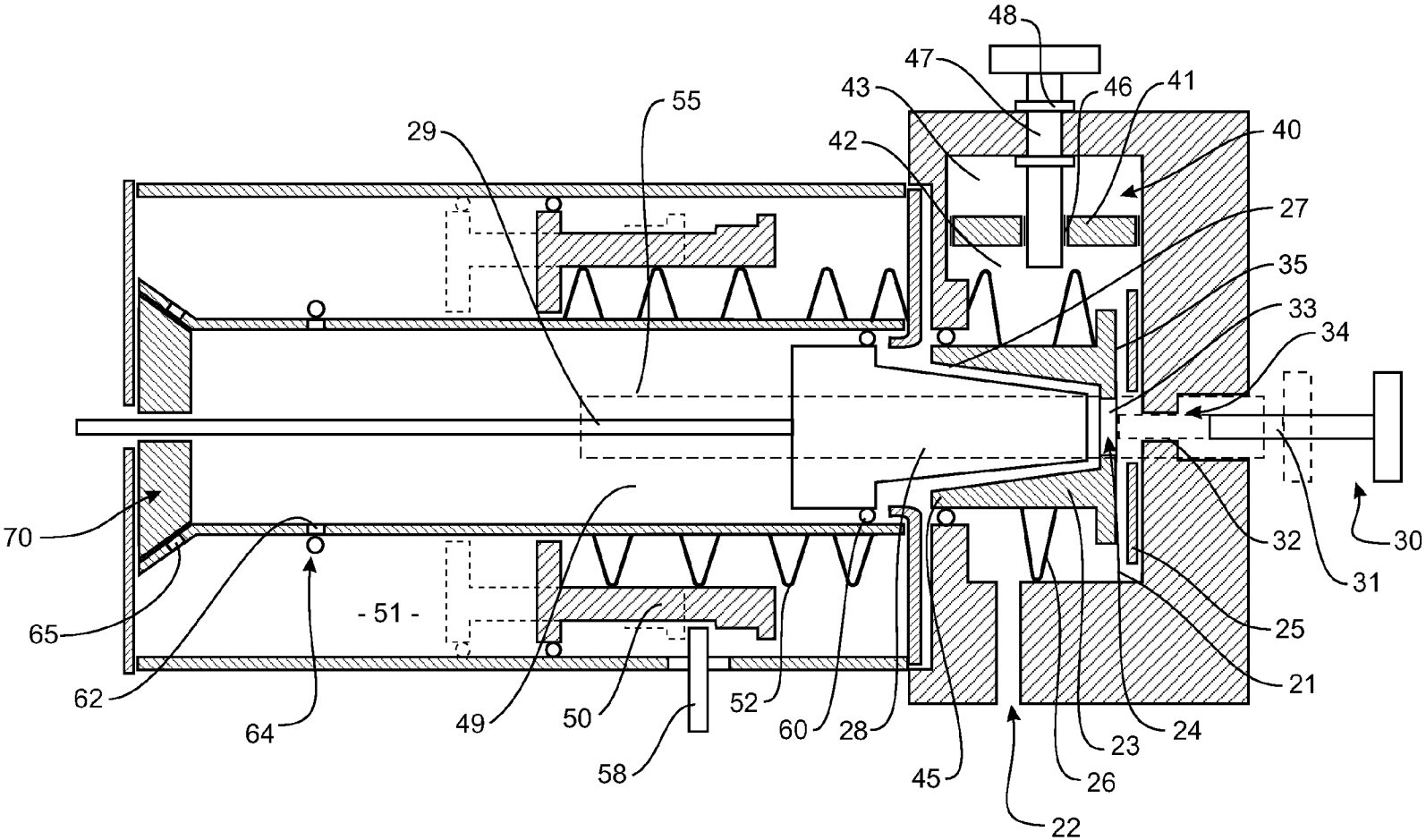
FIG. 3 illustrates an actuation mechanism for a nail gun incorporating the present invention.

FIG. 3 is useful to illustrate how this adjustable dose chamber works within a preferred arrangement of the nail gun. However the mechanism is applicable to other nail gun embodiments and to tools generally that include a drive piston.

In the nail gun of FIG. 3 gas is supplied from a regulator through gas inlet (22). The chamber (21) is maintained charged with gas from the regulator between actuations. No additional valve is required in the inlet path from the regulator to the chamber.

According to a preferred form the fluid path from the regulator to the inlet (22) includes an extended conduit, with a large part of the path of the conduit being adjacent the actuation mechanism of the gun. In particular adjacent the barrel of the gun, outside and around the piston chamber.

The dose chamber (21) is essentially annular around the body of valve (23).

Dose chamber (21) may include an annex (40) providing additional volume. The annex (40) may include an adjustable divider (41) dividing the annex into a primary space (42) and a secondary space (43). Movement of the divider (41) increases the size of one of the spaces at the expense of the other.

The gun includes a triggering and reset mechanism. Triggering is driven by releasing a compressed spring to drive the dose valve hammer onto the dose valve. Reset, including returning the triggering spring to the compressed condition, is driven by the last available expansion of the charge of gas.

The triggering and reset mechanism includes a reset piston (50) sliding in a bore (51) adjacent the piston chamber bore (49). The reset bore and the and the piston chamber bore are connected by fluid ports at a first position adjacent the forward end and a second position spaced from the forward end. The transfer ports (62) at the second position are covered by a valve member so that gases can only flow from the piston chamber to the bore (51). In the preferred form the bore (51) is an annular chamber surrounding the piston chamber. In this arrangement the reset piston (50) is an annular ring, and the valve member for covering the second ports may be an elastomeric o-ring (64).

A spring (52) is located between the reset piston and the rear end wall (53) of the bore (51). A trigger arrangement includes a tang (58) that extends into the bore (51) and engages the reset piston (50) in a cocked position. In this position the spring (52) is compressed between the reset piston (50) and the wall (53). Depressing the trigger moves the tang to release the reset piston (50). The spring (52) accelerates the piston (50) in a forward direction down bore (51).

A connecting member (55) (which may be in the form of a rod) extends rearward from the reset piston (50). The connecting member extends through a port in the end wall (53) of the bore (51) and connects to dose valve hammer (31).

When the reset piston (50) accelerates forward along the bore (51) the connected dose valve hammer (31) accelerates toward the impact point (33) of valve (23). The hammer (31) passes opening (32) and impacts the valve (23). Upon impact, the momentum of the hammer (31) depresses valve (23), releasing high pressure gas from the dose chamber (21) into the piston chamber. This high pressure gas drives the piston head forward along the piston chamber.

The valve spring (26) returns the valve to the closed position, at the same time pushing back the dose valve hammer (31) until it just protrudes through port (32). The opening time of the dose valve depends on the stiffness of and compression or extension of springs (26) and (52), the mass of the moving parts and the exposed surfaces subjected to the gas pressures. Adjustment of these factors can provide for adjustment of the amount of the time the valve remains open.

Once the outer seal (60) of the piston head (28) passes transfer ports (62) the transfer ports are exposed to the driving gases at a reduced, but still elevated, pressure. The pressure of these gases opens ring valve (64) and the gases flow into the bore (51). These gases push against the reset piston (50), pushing it rearward, compressing the spring (52). As the reset piston moves to the rear the connected dose valve hammer moves in a rearward direction to open an exhaust opening (68) from the piston chamber through port (32) and exhaust passage (34) through port (32) and exhaust passage (34).

Once the reset piston has returned sufficiently far to the rear it is engaged by the tang (58) of the trigger.

Further expansion of the gases in the bore (51) forces gas through a barrel vent (65) from the outer bore (51) to the piston chamber in front of the piston (28). This gas pushes the piston head to the rear of the piston chamber, expelling excess gases behind the piston head through the exhaust opening (34).

FIG. 3 shows the reset piston and dose valve hammer in the cocked position ready for firing. The released position of the hammer and reset piston, where the hammer holds the dose valve open, is shown in broken lines. The connecting member 55 is also shown in broken lines as it is hidden from view. The dose valve is shown in the open position, displaced away from seat (25). A resilient seal and buffer (70) is provided at the forward end of the gun. This buffer absorbs any impact of the piston into the end of the piston chamber, and seals against the driver blade (29) so that the residual gas pressure can push the piston back to the rear end of the piston chamber before dissipating.

If the nail gun fails to reset properly, for example due to inadequate gas pressure against the reset piston, the system can be recocked by pulling back the dose valve hammer. This has the effect of also pulling back the reset piston until it is locked by the tang. Preferably a cocking lever is provided on the rear of the housing. The cocking lever includes a pivot and a handle portion. The dose valve hammer is engaged by the lever midway between the pivot and the handle portion, providing the user additional leverage in recocking. Preferably, the present invention provides a chamber of a particular volume for one repetition of a pneumatically powered tool. The pneumatically prepared tool may be, for example, a nail gun, a jack hammer, or pruning shear. However a chamber according to the present invention may be used in other devices desiring an adjustable charge of high pressure gas.

For example, the pressurised chamber may be implemented in a paintball gun. Paintball is a game or sport where the typical distance between players varies greatly between playing fields or even during a game.

In order to use a single paintball gun safely and efficiently across a variety of ranges, the player should have the ability to easily adjust the volume of the pressurised chamber and hence power and range of the paintball gun. A player would then be able to switch between roles as a long range sniper to a close quarter assault player as the game progresses.

This also allows the player to preserve their supply of pressurised fluid (typically carbon dioxide) where long range is not required.

This is applicable to any situation where the supply of fluid is limited. Allowing for a reduction in volume of fluid to be used per repetition means that a greater number of repetitions may be achieved—which is a significant advantage if the power of the adjusted charge is still sufficient for the task at hand.

Reference to an inlet and an outlet should be understood to mean the flow pathways by which fluid enters and exits the pressurised chamber respectively.

It is envisaged that at least the outlet incorporate a valve mechanism in order to control the flow of fluid from the chamber. However, this valve mechanism may be implemented at a point separate to the pressurised chamber and reference to the outlet incorporating a valve mechanism should not be seen as limiting.

The inlet may also include a valve mechanism. Alternatively, the flow of fluid into the chamber may be governed by the equalisation of pressure in the chamber with the pressure of a high pressure source. In that case, the flow path from the high pressure source to the chamber (6) is typically much higher resistance than the flow path from the chamber outlet (4). This could be achieved by selecting the length and size of the conduit, or one or more restrictors, or by a regulator at the source. Accordingly most of the flow through the outlet (4) in a single actuation comes from the charge in the chamber (6) not from chamber (7) or inlet (3). Between actuations the chambers (6) and (7) are recharged through inlet (3).

In this specification reference to fluid should be understood to mean any substance that is capable of flowing and substantial volume change under compression. In a preferred embodiment the fluid is a gas.

Preferably the fluid is gaseous carbon dioxide. Carbon dioxide has numerous properties which make it useful for application in properly designed pneumatic applications. Carbon dioxide may be highly pressurised in order to store a high quantity in a small volume, and this high pressure allows for a high power output of the pneumatic tool.

Further, carbon dioxide is a relatively inexpensive gas to use.

This should not be seen as limiting, as any number of gases may be used with the present invention. For example, the fluid may be air from an air compressor, as commonly used with pneumatic tools. The increased efficiencies of the present invention over the prior art may allow the use of a smaller compressor and lighter air hoses where this was desirable. As a result the initial purchase and running costs to the user may be reduced, the compressor may be easier to transport, the tool with attached hose may be easier to manipulate, and noise of the system may be reduced.

Reference to a flow pathway throughout the specification should be understood to mean any passage through which fluid may pass.

Reference to equalising flow pathways should be understood to refer to any manner in which fluid may transfer between the two spaces of the pressurised chamber.

In a preferred embodiment, the flow pathways are formed by the selection of thread pitch between the divider and the chamber such that fluid may flow between the two spaces.

However, this should not be seen to be limiting as the equalising flow pathways may be formed by ports within the body of the divider, or entirely separate flow pathways formed in the body of the chamber itself.

As fluid enters the pressurised chamber, and the pressure differential between the two spaces on either side of the divider increases, fluid will pass through the flow pathway in order that the pressure differential is lessened. Because of this lower pressure differential between the two spaces, the divider may be more easily moved within the chamber, particularly when decreasing the volume of the more highly pressurised space. Without the flow pathways, the movement of the divider within the chamber would be against a significant pressure differential between the spaces and require application of force which may be beyond the means of a user manually operating the tool.

It is envisaged that although the flow pathways allow the reduction of pressure differential the two spaces, the flow rate through the flow pathways is significantly lower than that which may be achieved through the inlet and outlet of the chamber.

Accordingly, when a cycle of pressurising the first space through the inlet and releasing the fluid through the outlet is repeated, the volume of fluid flowing through the flow pathways will be significantly lower than that flowing in and out of the first space.

Preferably, the present invention provides an outlet that includes a valve, opening in use for an opening time to release fluid from the primary space of the dose chamber reducing the pressure in the primary space of the dose chamber from a high pressure to a low pressure and equalisation of pressure across the divider from a starting point of high pressure in the primary chamber and the low pressure in the secondary dose chamber takes at least four times the opening time.

Preferably the flow pathway past the divider offers at least four times the resistance as the outlet in use.

It is envisaged that the at least one flow pathway will allow the passage of fluid equally in both directions. It would be advantageous if the flow pathway was integrally formed with the divider, and did not require moving parts. However, this should not be seen as limiting as the least one flow pathway may include a limiting device such as a valve or filter.

To restrict, but not block the flow of fluid to a greater extent in one direction, the limiting device may be configured to allow variable degrees of flow of the fluid.

In a preferred embodiment, the pressurised chamber has a circular cross-section. One skilled in the art should appreciate that this is not intended to be limiting. For example with the embodiments of FIGS. 2*b* and 2*c* the cross-section of the pressure chamber may effectively be any shape.

In a preferred embodiment, the divider has substantially the same shape and dimensions as the interior cross-section of the chamber.

In a preferred embodiment the divider may be moved axially within the chamber.

In a preferred embodiment the divider may be connected to an adjustment mechanism.

It is envisaged that the adjustment mechanism may take the form of a rod, the end of which may be connected to a turning knob exterior to the chamber.

In a preferred embodiment, the divider may be externally threaded at its connection to the chamber and configured to engage a corresponding threaded portion of the chamber.

Translation of the divider through the chamber may then be facilitated by rotating the divider via the rod and associated turning knob.

It should be appreciated that this is not intended to be limiting, and that translation of the divider within the chamber may be achieved in any number of ways known to those skilled in the art. By way of example, the divider may be moved by application of axial force and have a separate locking mechanism to hold it in place within the chamber.

Alternatively, as in FIG. 2*b*, the rod may be threaded and engage a corresponding threaded portion of the pressure chamber. As the turning knob is rotated, the rod and the attached divider may be translated.

In a further alternative, as in FIG. 2*c*, the divider may internally threaded at its connection to the rod, the rod being configured to be capable of rotation about its axis, but in a fixed position within the chamber. As the turning knob and rod are rotated, the divider may be translated within the chamber along the width of the rod.

In a pneumatic tool such a nail gun, the pressure chamber may be utilised to contain a specific volume of pressurised gas to be used in the next cycle or shot of the tool. The volume of gas within the chamber corresponds to the resulting force or impact of the tool. Essentially, with reference to a nail gun the larger the volume of the chamber, the greater the force applied to the nail will be.

It should be appreciated that the pressure level of the chamber is maintained throughout adjustment, to ensure consistent operation of the tool.

Where the dimensions of the nail or specifications of the working material require less force, adjustment of the pressurised chamber facilitates this. As a result, the most efficient use of gas for the job at hand is achieved.

The reduced force required may also allow the tool to be used for a longer period of time.

Where the fluid is carbon dioxide the temperature of the fluid is such that the continual exposure of the operating mechanism to the fluid causes it to freeze. Continued use of the tool in this frozen state is detrimental to the tool's condition, and may also pose a safety hazard to the user were the tool to malfunction.

The ability to adjust the power of the tool will result in a smaller amount of fluid being used per operating cycle, reducing the degree to which the temperature of operating mechanism will be lowered. From this, a greater number of repetitions may be achieved before freezing issues arise—increasing the usability of the tool.

It is envisaged that the adjustable pressure chamber will have one end fixedly attached to the rest of the chamber in order to facilitate the maintenance of the internal components of the chamber. The end may be fixedly attached by any means known to one skilled in the art, such as a screw fitting, latches, bolts, or any number of other mechanisms.

The present invention offers a number of advantages over the prior art:

The volume of fluid may be adjusted according to the required power of the tool. This allows a single tool to operate in a variety of applications, particularly where the properties of the materials used in conjunction with the tool require different power capabilities.

Allows adjustment of the pressure chamber regardless of whether or not the chamber is currently pressurised. This reduces the complexity of decision making as to when the volume may be adjusted.

Where the fluid is of a low temperature, reduction in volume size allows the tool to achieve an increased number of repetitions due to the lowering of the dissipation requirements per repetition.

Further, where the supply of fluid is limited, the reduction in volume will allow a greater number of repetitions to be achieved. This reduces the time and cost to the user spent refilling the supply of fluid, and prevents disruptions to the task at hand.

Aspects of the present invention have been described by way of example only and it should be appreciated that modifications and additions may be made thereto without departing from the scope thereof.

The invention claimed is:

1. A compressible fluid powered device comprising:

a dose chamber, a moveable divider dividing the dose chamber into a primary space and a secondary space, movement of the moveable divider expanding one space at the expense of the other, an inlet for supplying pressurised fluid to the primary space of the dose chamber, an outlet for releasing pressurised fluid from the primary space of the dose chamber, and at least one flow pathway between the primary space and the secondary space, which collectively allow gas to flow in both directions and pressure to equalise across the moveable divider, the flow pathway being more restricted than the outlet;

wherein the moveable divider is connected to an adjustment mechanism.

2. A compressible fluid powered device as claimed in claim 1 wherein the outlet includes a valve mechanism in order to control the flow of fluid from the chamber.

3. A compressible fluid powered device as claimed in claim 1 wherein in the region of the moveable divider, the dose chamber has a circular cross-section.

4. A compressible fluid powered device as claimed in claim 1 wherein the moveable divider has substantially the same shape and dimensions as a portion of the interior cross-section of the chamber.

5. A compressible fluid powered device as claimed in claim 1 wherein the moveable divider is moved axially within the chamber.

6. A compressible fluid powered device as claimed in claim 1 wherein the adjustment mechanism includes a rotating member, the end of which is rotatable from outside the chamber.

7. A compressible fluid powered device as claimed in claim 6 wherein the moveable divider is externally threaded and configured to engage a corresponding threaded portion of the chamber; and wherein translation of the moveable divider through the chamber is effected by rotating the moveable divider via the rotating member.

8. A compressible fluid powered device as claimed in claim 7 wherein the flow pathways are formed by the selection of thread pitch between the moveable divider and the chamber, thereby allowing fluid to flow between the two spaces.

9. A compressible fluid powered device as claimed in claim 6 wherein the rotating member is threaded and engages a corresponding threaded portion of the chamber; and wherein, as the rotating member is rotated, the rotating member and the attached moveable divider are translated.

10. A compressible fluid powered device as claimed in claim 9 wherein flow pathways are formed between the edge of the moveable divider and the wall of the chamber.

11. A compressible fluid powered device as claimed in claim 9 comprising:

a piston chamber divided from the outlet of the dose chamber by a valve, a piston slidable in the piston chamber, and an implement drivable by movement of the piston.

12. A compressible fluid powered device as claimed in claim 11 wherein the implement is a driver blade of a nail gun.

13. A compressible fluid powered device as claimed in claim 6 wherein a portion of the rotating member is threaded and engages with an internally threaded portion of the moveable divider, the rotating member being configured to be capable of rotation about an axis, but in a fixed axial position within the chamber; and wherein rotating the rotating member translates the moveable divider within the chamber along a length of the rotating member.

14. A compressible fluid powered device as claimed in claim 13 wherein the flow pathways are formed by the selection of thread pitch between the moveable divider and the rotating member, thereby allowing fluid to flow between the two spaces.

15. A compressible fluid powered device as claimed in claim 6 wherein flow pathways comprise ports within the body of the moveable divider.

16. A compressible fluid powered device as claimed in claim 6 wherein flow pathways comprise separate flow pathways formed in the body of the chamber.

17. A compressible fluid powered device as claimed in claim 1 comprising:

a connection for a source of high pressure gas, a conduit leading from the connection to the inlet of the dose chamber, a working chamber where pressurised gas expands to power the device and a valve between the outlet and the working chamber.

18. A compressible fluid powered device as claimed in claim 1 wherein the outlet includes a valve, opening in use for an opening time to release fluid from the primary space of the dose chamber reducing the pressure in the primary space of the dose chamber from a high pressure to a low pressure and equalisation of pressure across the moveable divider from a starting point of high pressure in the primary chamber and the low pressure in the secondary dose chamber takes at least four times the opening time.

19. A compressible fluid powered device as claimed in claim 1 wherein the flow pathway offers a resistance to flow of at least four times greater than a resistance to flow through the outlet in use.

20. A compressible fluid powered device as claimed in claim 1 wherein the adjustment mechanism is adapted to adjust the location of the moveable divider within the dose chamber.

21. A compressible fluid powered device comprising:

a dose chamber, a moveable divider dividing the dose chamber into a primary space and a secondary space, movement of the moveable divider expanding one space at the expense of the other, an inlet for supplying pressurised fluid to the primary space of the dose chamber, an outlet for releasing pressurised fluid from the primary space of the dose chamber, and at least one flow pathway between the primary space and the secondary space, which collectively allow gas to flow in both directions past the moveable divider and pressure to equalise across the moveable divider;

wherein the divider is connected to an adjustment mechanism adapted to adjust the location of the moveable divider within the dose chamber.

22. A compressible fluid powered device comprising:

a dose chamber, a moveable divider dividing the dose chamber into a primary space and a secondary space, movement of the moveable divider expanding one space at the expense of the other, an inlet for supplying pressurised fluid to the primary space of the dose chamber, an outlet for releasing pressurised fluid from the primary space of the dose chamber, and at least one flow pathway between the primary space and the secondary space, the flow pathway being more restricted than the outlet;

wherein the divider is connected to an adjustment mechanism adapted to adjust the location of the moveable divider within the dose chamber.

* * * * *